United States Patent [19]

Taniguchi

[11] Patent Number: 4,885,445

[45] Date of Patent: Dec. 5, 1989

[54] HIGH-FREQUENCY TRANSFORMER FOR MICROWAVE OVEN

[75] Inventor: Hisaya Taniguchi, Nagoya, Japan

[73] Assignee: Kabushiki Kaisha Toshiba, Kawasaki, Japan

[21] Appl. No.: 281,524

[22] Filed: Dec. 8, 1988

[30] Foreign Application Priority Data

Dec. 9, 1987 [JP] Japan ..... 62-311242

[51] Int. Cl.[4] ..... H05B 6/64

[52] U.S. Cl. ..... 219/10.55 B; 219/10.55 R; 336/178; 336/134

[58] Field of Search ..... 219/10.55 B, 10.55 R; 336/178, 134, 212, 131; 323/362, 359

[56] References Cited

U.S. PATENT DOCUMENTS

| | | | |
|---|---|---|---|
| 2,064,771 | 12/1936 | Vogt | 336/178 |
| 3,514,566 | 5/1970 | Ironfield | 219/10.55 B |
| 3,515,986 | 6/1970 | Peschel | 336/134 X |
| 3,979,707 | 9/1976 | Prince, Jr. | 336/107 |
| 4,529,956 | 7/1985 | Atherton | 336/134 X |
| 4,587,506 | 5/1986 | Hoeksma | 336/178 |

FOREIGN PATENT DOCUMENTS

| | | | |
|---|---|---|---|
| 96807 | 12/1983 | European Pat. Off. . | |
| 154052 | 9/1985 | European Pat. Off. . | |
| 50-32733 | 9/1975 | Japan . | |
| 55-105309 | 8/1980 | Japan | 336/178 |
| 56-3636 | 1/1981 | Japan . | |

*Primary Examiner*—Philip H. Leung

*Attorney, Agent, or Firm*—Foley & Lardner, Schwartz, Jeffery, Schwaab, Mack, Blumenthal & Evans

[57] ABSTRACT

A high-frequency transformer for a microwave oven comprises: an E-shaped first core of ferrite of a low-voltage side; a primary winding wound around the first core over a coil bobbin; an E-shaped second core of ferrite of a high-voltage side disposed in opposition with the first core with a specific gap therebetween; a gap-filling insulation material interposed between the first and second cores; a secondary winding wound around the second core; and a grounding plate connected electroconductively between the first core and a bottom plate of the microwave oven, wherein the distance between the primary winding and the first core is greater than the gap between the two cores.

2 Claims, 1 Drawing Sheet

HIGH-FREQUENCY TRANSFORMER FOR MICROWAVE OVEN

BACKGROUND OF THE INVENTION

This invention relates generally to voltage transformers and to microwave devices and more particularly to high-frequency transformers for microwave cookers or ovens. More specifically the invention relates to a high-frequency transformer for a microwave oven in which transformer short-circuiting between the windings of the primary coil and the secondary coil is positively prevented.

In general, a microwave cooker or oven for cooking by heating materials to be cooked is provided with a built-in magnetron, to which high-frequency power from a step-up transformer is supplied through a rectifier. A step-up transformer of this type has a primary winding connected to a commercial power supply and a secondary winding connected to the magnetron side, which windings are wound on a common coil bobbin (for example, as described in Japanese Patent Publication No. 3636/1981 and Utility Model Publication No. 32733/1976). Although ample electrical insulation is originally provided between these primary and secondary windings at the time of manufacture, the electrical insulation layer ruptures and causes short-circuiting in some cases after use over a long period at a high potential difference.

SUMMARY OF THE INVENTION

Accordingly, it is a general object of this invention to provide a high-frequency transformer for a microwave oven in which the above described problem accompanying known high-frequency transformers is solved, and the insulation between the primary winding of the low-voltage part and the secondary winding of the high-voltage part is improved, whereby short-circuiting therebetween is prevented and the degree of safety is elevated.

According to this invention there is provided a high-frequency transformer for a microwave oven comprising: an E-shaped first core of ferrite of a low-voltage side; a primary winding wound around the first core over a coil bobbin; an E-shaped second core of ferrite of a high-voltage side disposed in opposition with the first core with a specific gap therebetween; a gap-filling insulation material interposed between the first and second cores; a secondary winding wound around the second core; and a grounding plate connected electroconductively between the first core and a bottom plate of the microwave oven, wherein the distance between the primary winding and the first core is greater than the gap between the two cores.

According to this invention, the distance between the primary winding and the E-shaped ferrite core on the low-voltage side is made large, and at the same time, this ferrite core is grounded to the chassis of the microwave oven. Therefore, short-circuiting between the primary and secondary windings is prevented, and safety at the time of use is assured.

The nature, utility, and further features of this invention will be more clearly apparent from the following detailed description with respect to preferred embodiments of the invention when read in conjunction with the accompanying drawing, briefly described below.

DETAILED DESCRIPTION OF THE INVENTION

Figure 1:
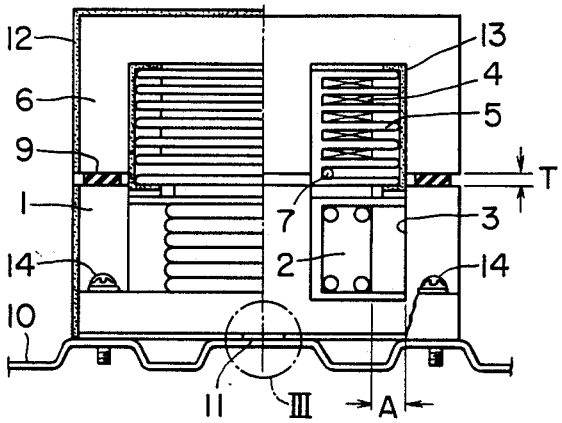
FIG. 1 is a combination of two half axial sections showing one example of the high-frequency transformer according to this invention for a microwave oven.
Figure 2:
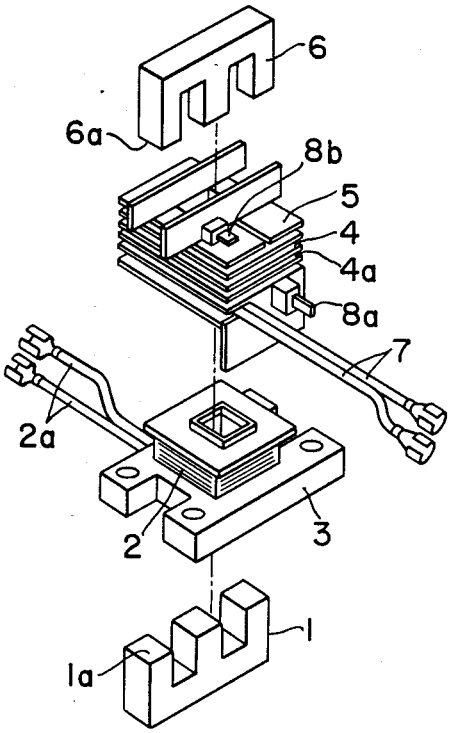
FIG. 2 is an exploded perspective view of the transformer.
Figure 3:
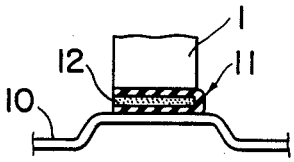
FIG. 3 is an enlarged fragmentary view, in section, of the part III in FIG. 1.

Referring first to FIGS. 1, 2, and 3, the example of the high-frequency transformer according to this invention shown therein has a ferrite core assembly comprising an E-shaped lower ferrite core 1 and an E-shaped upper ferrite core 6 assembled in mutually opposed relationship with a specific gap therebetween. On the lower core 1 is fitted a primary coil bobbin 3, around which is wound a primary coil 2 having lead wires **2*a*. Above the primary coil bobbin 3 is disposed a secondary coil bobbin 5, around which is wound a secondary coil 4 of enameled wire (solid wire). On this secondary coil bobbin 5 is fitted the upper core 6**.

At the lower part of the secondary coil bobbin 5 are heater coil leads 7. Terminals **8*a* and 8*b* supply filament voltage to, for instance, a magnetron. Furthermore, a gap filling insulation material 9 made of insulative paper is interposed between the upper surface of the lower core 1 and the lower surface 6*a* of the upper core 6. This gap filling insulation material 9 forms the insulation distance T according to the creepage distance. A feature of this insulation distance T is that it positively maintains the insulation distance between the high-voltage part 4*a* of the secondary coil 4 and the upper and lower cores 6 and 1 and constitutes an insulation part in a manner to improve the magnetic saturation of the upper and lower cores 6 and 1**.

Figure 4:
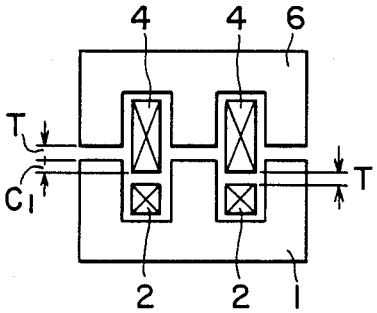
FIG. 4 is a side sectional view showing another example of the high-frequency transformer according to the invention.

Furthermore, as shown in FIG. 4, a portion of the secondary coil 4 extends downward into the lower core 1. The transformer is mounted on the bottom plate 10 of a microwave oven (not shown), the lower core 1 being fixed to the bottom plate 10 by mounting screws 14 with a copper plate 11 for grounding interposed between the lower surface of the lower core 1 and the bottom plate 10 for connection therebetween. The copper plate 11 for grounding is fixed by an outer peripheral tape 12 for fixing. Around the outer periphery of the secondary coil bobbin 5 and the heater coil 7 is provided an insulation 13 made of insulative paper. The outer peripheral tape 12, which is fixing the copper plate 11 for grounding, is wrapped around the outer surfaces of the lower and upper cores 1 and 6.

An important feature of the construction of this transformer is that, between the outer periphery of the primary coil 2 and the lower core 1, a creepage space distance A (FIG. 1) is provided, and that this distance A is formed to be amply greater than the insulation distance T based on the creepage distance and formed by the gap filling insulation material 9. The significance of this creepage space distance will be described hereinafter.

The principal parts of the high-frequency transformer of the above described construction according to this invention are assembled and mounted in the following manner.

The primary coil 2 is wound around the primary coil bobbin 3, which is then fitted on the lower core 1. The secondary coil 4 is wound around the secondary coil bobbin 5, which is then positioned above the primary coil bobbin 3, and on which the upper core 6 is fitted. The gap filling insulation material 9 is interposed between the upper core 6 and the lower core 1, which are thus assembled. Then, in the case where the transformer is to be mounted in a microwave oven, the copper plate 11 for grounding is inserted between the lower core 1 and the bottom plate 10 of the oven, and the primary coil bobbin 3 is then fixed to the bottom plate 10 by means of the mounting screws 14.

The construction as described above of the transformer of this invention affords the following meritorious effects and advantages.

As mentioned briefly hereinbefore, the creepage space distance A between the primary coil 2 and the lower core 1 is made amply greater than the insulation distance T defined by the gap filling insulation material 9. Because of this provision, even if the insulation material 9 should rupture for some unlikely reason, an electric potential of high voltage will be impressed between the upper core 6 and the lower core 1 across the insulation distance (gap) T. Furthermore, since the lower core 1 is grounded by way of the copper plate 1 for grounding to the bottom plate 10 of the oven the high-voltage side and the ground side assume the same potential, whereby a closed circuit is formed.

In this manner, an ample insulation distance is secured between the low-voltage part of the primary coil 2 and the high voltage part of the secondary coil 4 and the heater coil 7. Furthermore, since the lower core 1 of low voltage is grounded by way of the grounding copper plate 11 to the bottom plate 10, not only can short-circuiting between the primary coil 2 of high voltage and the secondary coil 4 be prevented, but improvement in safety can be attained. In addition, since a portion of the secondary coil 4 is lapped over the lower core 1, even if the high-voltage insulation should rupture, the high voltage will be grounded through the grounding copper plate. 11 to the bottom plate 10 without being impressed on the primary coil 2, whereby safety is assured.

What is claimed is:

1. A high-frequency transformer in a microwave oven, comprising:

an E-shaped first core forming the low-voltage side of the transformer, the core being made of a ferrite;

a primary winding wound around said first core over a coil winding bobbin;

an E-shaped second core forming the high-voltage side of the transformer, the second core also made of a ferrite, the second core disposed in opposition to said first core with a gap of a predetermined distance maintained therebetween;

an insulating material inserted in said gap for electrically insulating said second core from said first core;

a secondary winding wound around said second core over a coil bobbin; and a grounding plate electrically connecting said first core to a bottom plate of said microwave oven, wherein the creepage distance formed between said primary winding and adjacent surface of said first core is greater than the width of the gap formed between said first and second cores.

2. A high-frequency transformer as claimed in claim 1 wherein said secondary winding wound around said second core intrudes downward such that one part of the secondary winding is wound around said gap forming portion of said two cores over a coil bobbin.

* * * * *